US008044910B2

(12) United States Patent
Song et al.

(10) Patent No.: US 8,044,910 B2
(45) Date of Patent: Oct. 25, 2011

(54) LIQUID CRYSTAL DISPLAY DEVICE AND METHOD FOR DRIVING THEREOF

(75) Inventors: Hong Sung Song, Gumi-si (KR); Woong Ki Min, Daegu-si (KR); Su Hyuk Jang, Daegu-si (KR)

(73) Assignee: LG Display Co., Ltd, Seoul (KR)

( * ) Notice: Subject to any disclaimer, the term of this patent is extended or adjusted under 35 U.S.C. 154(b) by 802 days.

(21) Appl. No.: 12/149,833

(22) Filed: May 8, 2008

(65) Prior Publication Data

US 2008/0284704 A1 Nov. 20, 2008

(30) Foreign Application Priority Data

May 11, 2007 (KR) ..... 10-2007-0046124

(51) Int. Cl.
*G09G 3/36* (2006.01)

(52) U.S. Cl. ..... 345/96; 345/99

(58) Field of Classification Search ..... 345/209, 345/210, 54, 96, 94, 99
See application file for complete search history.

(56) References Cited

U.S. PATENT DOCUMENTS

| | | | | |
|---|---|---|---|---|
| 4,417,785 | A * | 11/1983 | Nakamura | 349/33 |
| 6,535,194 | B1 * | 3/2003 | Hanano et al. | 345/101 |
| 7,123,246 | B2 * | 10/2006 | Nakatani et al. | 345/204 |
| 2006/0007091 | A1 * | 1/2006 | Yang et al. | 345/89 |

* cited by examiner

*Primary Examiner* — Chanh Nguyen
*Assistant Examiner* — Ram Mistry
(74) *Attorney, Agent, or Firm* — McKenna Long & Aldridge LLP

(57) ABSTRACT

A liquid crystal display (LCD) device and a method for driving the LCD device are disclosed. The LCD device includes a frame rate adjusting circuit for controlling a frame rate to be maintained at a 1-fold rate in frame periods other than an Nth frame period ("N" is a multiple of 8 or more), while being increased to an "i"-fold-accelerated rate ("i" is a positive integer of 2 or more) in the Nth frame period, to output reference timing signals in the frame periods other than the Nth frame period, and to output accelerated timing signals in the Nth frame period, a timing controller for generating data and gate timing control signals, based on at least one of each reference timing signal and each accelerated timing signal, and a logic circuit for accelerating a frequency of a polarity control signal in the Nth frame period.

7 Claims, 19 Drawing Sheets

FIG. 7

| Frame | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 |
|---|---|---|---|---|---|---|---|---|---|---|---|---|---|---|---|---|---|---|---|---|---|---|---|---|---|---|---|---|---|---|
| POL | + | - | + | - | + | - | + | + | - | + | - | + | - | + | - | + | + | - | + | - | + | - | + | + | - | + | - | + | - | + |

| Frame | 31 | 32 | 33 | 34 | 35 | 36 | 37 | 38 | 39 | 40 | 41 | 42 | 43 | 44 | 45 | 46 | 47 | 48 |
|---|---|---|---|---|---|---|---|---|---|---|---|---|---|---|---|---|---|---|
| POL | - | - | + | - | + | - | + | - | + | + | - | + | - | + | - | + | - | - |

LIQUID CRYSTAL DISPLAY DEVICE AND METHOD FOR DRIVING THEREOF

This application claims the benefit of the Korean Patent Application No. 10-2007-0046124, filed on May 11, 2007 which is hereby incorporated by reference for all purposes as if fully set forth herein.

BACKGROUND OF THE INVENTION

1. Field of the Invention

The present invention relates display devices, and more particularly, to a liquid crystal display (LCD) device and a driving method thereof for reducing or eliminating direct current image sticking and flicker.

2. Discussion of the Related Art

LCD devices display an image by controlling the light transmittance of liquid crystal cells in accordance with a video signal. FIG. 1 illustrates a liquid crystal cell of an active matrix type LCD device. In such an active matrix type LCD device, data voltages, which are supplied to liquid crystal cells Clc, are switched by thin film transistors (TFTs) formed in respective liquid crystal cells Clc under the active control of data to achieve an enhancement in the display quality of a moving image. In FIG. 1, the reference character "Cst" designates a storage capacitor to maintain the data voltage charged in the associated liquid crystal cell Clc, the reference character "DL" designates a data line to be supplied with the data voltage, and the reference character "GL" designates a gate line to be supplied with a scan voltage.

The LCD display device having the above described structure may be driven in accordance with an inversion scheme, in which polarity inversion not only occurs between neighboring liquid crystal cells, but also occurs at intervals of one frame, in order to reduce a DC offset of voltages applied to the cells and to reduce degradation of the liquid crystals. However, when any one of data voltages having opposite polarities is dominantly supplied for a prolonged period of time, image sticking may occur. Such image sticking is called "DC (direct current) image sticking" because it occurs when a liquid crystal cell is repeatedly charged with voltages having the same polarity. An example of such a case is the case in which data voltages are supplied to the LCD device in accordance with an interlace scheme. In accordance with the interlace scheme, data voltages are supplied to liquid crystal cells on odd horizontal lines in odd frame periods, while being supplied to liquid crystal cells on even horizontal lines in even frame periods.

FIG. 2 is a waveform diagram depicting an example in which data voltages are supplied to each liquid crystal cell Clc in accordance with the interlace scheme. In this example, it is assumed that the liquid crystal cell Clc supplied with the data voltages depicted in FIG. 2 is one of the liquid crystal cells arranged on one odd horizontal line.

Referring to FIG. 2, a positive voltage is supplied to the liquid crystal cell Clc in odd frame periods, and a negative voltage is supplied to the liquid crystal cell Clc in even frame periods. Since a data voltage having a high positive polarity level is supplied to liquid crystal cells Clc arranged on odd horizontal lines, only in odd frame periods, in accordance with the interlace scheme, the positive data voltage becomes dominant during the 4 frame periods in comparison to the negative voltage, as shown by the waveform in the box of FIG. 2. FIG. 3 is an image showing the experimental results of DC image sticking occurring due to interlace data. When an original image corresponding to the left image in FIG. 3 is supplied to an LCD panel for a certain period of time in accordance with the interlace scheme, the data voltage, which is varied in polarity at intervals of one frame, exhibits a considerable level difference between the odd frame and the even frame, as shown in FIG. 2. As a result, when a data voltage having an intermediate gray scale value, for example, a gray scale value of 127, is supplied to all liquid crystal cells Clc of the LCD panel, after the display of an original image such as the left image in FIG. 3, the pattern of the original image is dimly displayed, as shown by the right image in FIG. 3. That is, DC image sticking occurs.

Another example of DC image sticking may be the case in which an image is moved or scrolled at a certain speed. When an image is moved or scrolled at a certain speed, voltages of the same polarity may be repeatedly accumulated in each liquid crystal cell Clc in accordance with the correlation between the size of the scrolled figure and the scroll speed (moving speed). This example is illustrated in FIG. 4. FIG. 4 is an image showing the experimental results of DC image sticking occurring when an oblique line pattern or a character pattern is moved at a certain speed.

The moving image display quality of the LCD device may be degraded not only due to DC image sticking, but also due to flicker, namely, a periodic brightness difference visible to the naked eye of a viewer. Therefore, it is desirable to prevent the occurrence of DC image sticking and flicker, in order to enhance the display quality of the LCD device.

SUMMARY OF THE INVENTION

Accordingly, the present invention is directed to a liquid crystal display device and a driving method thereof that substantially obviate one or more problems due to limitations and disadvantages of the related art.

An advantage of the present invention is to provide a liquid crystal display device and a driving method thereof, which are capable of preventing direct current (DC) image sticking and flicker, thereby achieving an enhancement in display quality.

Additional advantages and features of the invention will be set forth in part in the description which follows and in part will become apparent to those having ordinary skill in the art upon examination of the following or may be learned from practice of the invention. The advantages of the invention may be realized and attained by the structure particularly pointed out in the written description and claims hereof as well as the appended drawings.

To achieve these and other advantages and in accordance with the purpose of the invention, as embodied and broadly described herein, a liquid crystal display device includes: a liquid crystal display panel formed with a plurality of data lines and a plurality of gate lines, the liquid crystal display panel having a plurality of liquid crystal cells; a frame rate adjusting circuit for controlling a frame rate such that the frame rate is maintained at a 1-fold rate in frame periods other than an Nth frame period ("N" is a multiple of 8 or more), while being increased to an "i"-fold-accelerated rate ("i" is a positive integer of 2 or more) in the Nth frame period, to output reference timing signals in the frame periods other than the Nth frame period, and to output accelerated timing signals in the Nth frame period; a timing controller for generating data timing control signals and gate timing control signals in response to at least one of each reference timing signal and each accelerated timing signal; a logic circuit for accelerating a frequency of a polarity control signal to determine a polarity of a data voltage to be supplied to the liquid crystal cells, in the Nth frame period, the polarity control signal being included in the data timing control signals; a data driving circuit for generating the data voltage in response to the data timing control signals including the polarity control signal; and a gate driving circuit for supplying a scan pulse to the gate lines in response to the gate timing control signals.

The Nth frame period may comprise at least one first subframe period, in which a data voltage having a polarity opposite to the Nth frame period is supplied to the liquid crystal cells, and at least one second subframe period, in which a data voltage having the same polarity as the Nth frame period is supplied to the liquid crystal cells.

The frame rate adjusting circuit may comprise a frame determining circuit for determining a frame period, based on the reference timing signals, a timing signal multiplying circuit for multiplying the reference timing signals by the "i"-fold, to generate the accelerated timing signals, and a multiplexer for outputting the accelerated timing signals in the Nth frame period, while outputting the reference timing signals in the frame periods other than the Nth frame period, under a control of the frame determining circuit.

The logic circuit may comprise a frame counter for counting a gate start pulse indicating a start of the scan pulse, to count a number of frames, an inverter for generating an inverting signal indicating a point of time when the polarity control signal should be inverted in phase in the Nth frame period, in accordance with an output from the frame counter, an exclusive OR gate for exclusively ORing a reference polarity control signal generated from the timing controller and the inverting signal, to generate the polarity control signal, and a multiplexer for selectively outputting the reference polarity control signal or the polarity control signal.

In another aspect of the present invention, a liquid crystal display device includes: a liquid crystal display panel formed with a plurality of data lines and a plurality of gate lines, the liquid crystal display panel having a plurality of liquid crystal cells; an image determiner for analyzing input digital video data and determining whether one of interlaced data and scrolled data has been input based on results of the analysis; a frame rate adjusting circuit for controlling a frame rate such that the frame rate is maintained at a 1-fold rate in frame periods other than an Nth frame period (where "N" is a multiple of 8 or more), while being increased to an "i"-fold-accelerated rate (where "i" is a positive integer of 2 or more) in the Nth frame period upon a determination that one of interlaced data and scrolled data has been input, and to output reference timing signals in the frame periods other than the Nth frame period, and to output accelerated timing signals in the Nth frame period; a timing controller for generating data timing control signals and gate timing control signals, based on the reference timing signals upon a determination that one of interlaced data and scrolled data has been input, and for generating the data timing control signals and the gate timing control signals based on the accelerated timing signals upon a determination that data other than interlaced data and scrolled data has been input; a logic circuit for accelerating a frequency of a polarity control signal to determine a polarity of a data voltage to be supplied to the liquid crystal cells, in the Nth frame period, when one of the interlace data and the scroll data has been input, the polarity control signal being included in the data timing control signals; a data driving circuit for generating the data voltage in response to the data timing control signals including the polarity control signal; and a gate driving circuit for supplying a scan pulse to the gate lines in response to the gate timing control signals.

In another aspect of the present invention, a method for driving a liquid crystal display device including a liquid crystal display panel formed with a plurality of data lines and a plurality of gate lines, the liquid crystal display panel having a plurality of liquid crystal cells, includes: controlling a frame rate such that the frame rate is maintained at a 1-fold rate in frame periods other than an Nth frame period (where "N" is a multiple of 8 or more), while being increased to an "i"-fold-accelerated rate (where "i" is a positive integer of 2 or more) in the Nth frame period, to output reference timing signals in the frame periods other than the Nth frame period, and to output accelerated timing signals in the Nth frame period; generating data timing control signals and gate timing control signals, based on at least one of each reference timing signal and each accelerated timing signal; accelerating a frequency of a polarity control signal to determine a polarity of a data voltage to be supplied to the liquid crystal cells, in the Nth frame period, the polarity control signal being included in the data timing control signals; generating the data voltage in response to the data timing control signals including the polarity control signal; and supplying a scan pulse to the gate lines in response to the gate timing control signals.

In another aspect of the present invention, a method for driving a liquid crystal display device including a liquid crystal display panel formed with a plurality of data lines and a plurality of gate lines, the liquid crystal display panel having a plurality of liquid crystal cells includes: analyzing input digital video data and determining whether one of interlaced data and scrolled data has been input based on results of the analysis; controlling a frame rate such that the frame rate is maintained at a 1-fold rate in frame periods other than an Nth frame period ("N" is a multiple of 8 or more), while being increased to an "i"-fold-accelerated rate ("i" is a positive integer of 2 or more) in the Nth frame period, upon a determination that one of interlaced data and scrolled data has been input, to output reference timing signals in the frame periods other than the Nth frame period, and to output accelerated timing signals in the Nth frame period; generating data timing control signals and gate timing control signals, based on the reference timing signals upon the determination that one of interlaced data and scrolled data has been input; generating the data timing control signals and the gate timing control signals, based on the accelerated timing signals, upon a determination that data other than one of interlaced data and scrolled data has been input; accelerating a frequency of a polarity control signal to determine a polarity of a data voltage to be supplied to the liquid crystal cells, in the Nth frame period upon a determination that one of interlaced data and scrolled data has been input, the polarity control signal being included in the data timing control signals; generating the data voltage in response to the data timing control signals including the polarity control signal; and supplying a scan pulse to the gate lines in response to the gate timing control signals.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention.

In the drawings:

FIG. 7 is a diagram illustrating a principle of the an embodiment of the present invention for preventing the occurrence of DC image sticking in association with scrolled data in an LCD device driving method according to the embodiment of the present invention;

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Hereinafter, example embodiments of the present invention will be described with reference to FIGS. 5 to 19.

Figure 1:
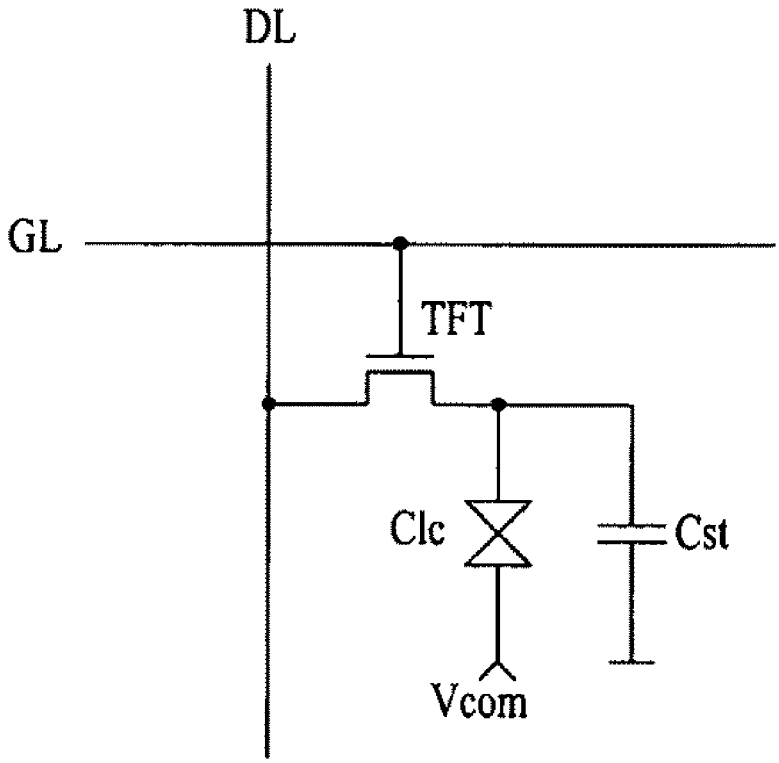
FIG. 1 Related Art
FIG. 1 is an equivalent circuit diagram illustrating one liquid crystal cell of a liquid crystal display (LCD) device.
Figure 2:
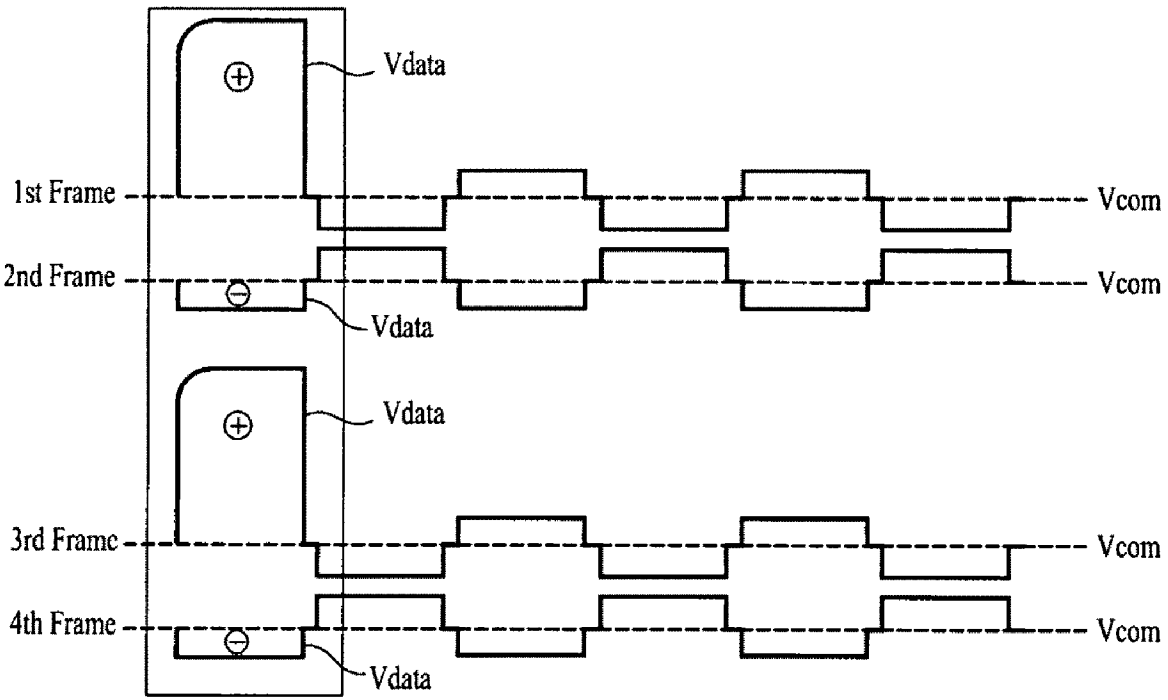
FIG. 2 Related Art
FIG. 2 is a waveform diagram illustrating example interlace data.
Figure 3:
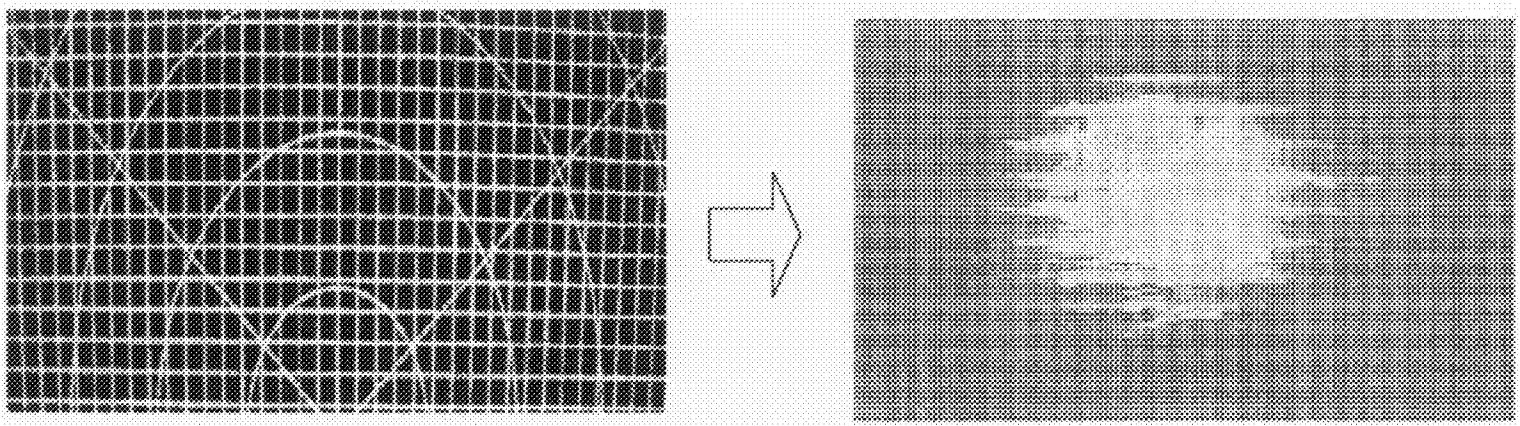
FIG. 3 Related Art
FIG. 3 is an image displayed on a screen, showing the experimental results of DC image sticking occurring due to interlace data.
Figure 4:
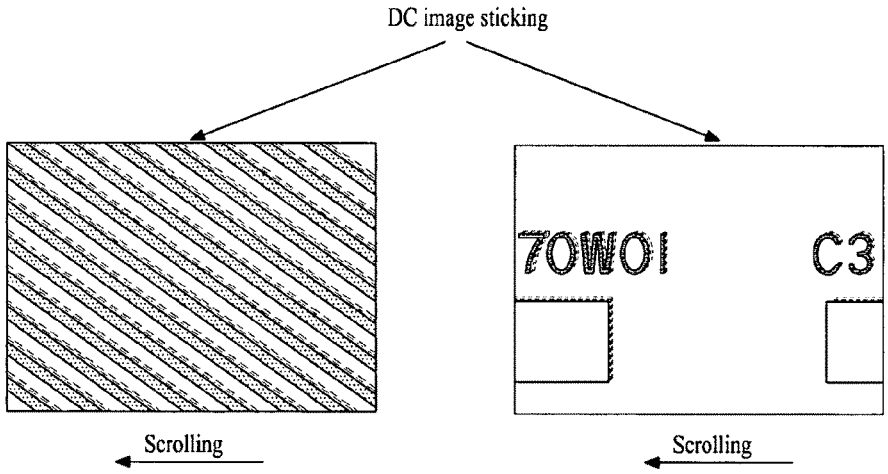
FIG. 4 Related Art
FIG. 4 is an image displayed on a screen, showing the experimental results of DC image sticking occurring due to scrolled data.
Figure 5:
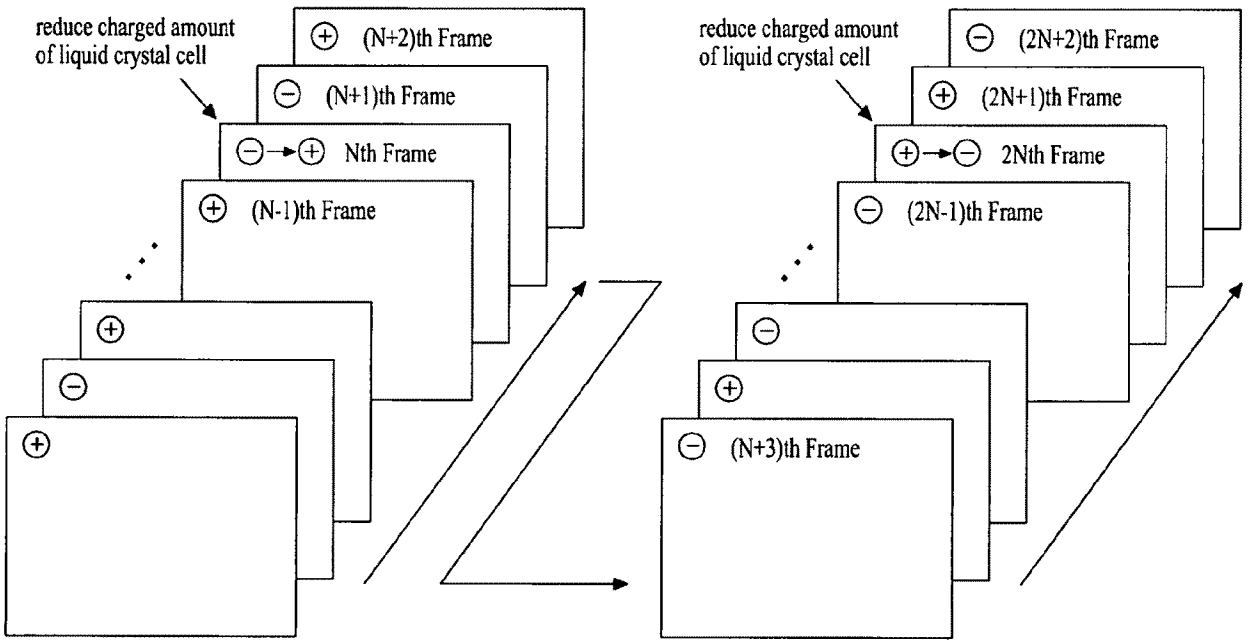
FIG. 5 is a view illustrating the polarities of voltages charged in respective frame periods in accordance with an LCD device driving method according to an embodiment of the present invention.
Figure 6:
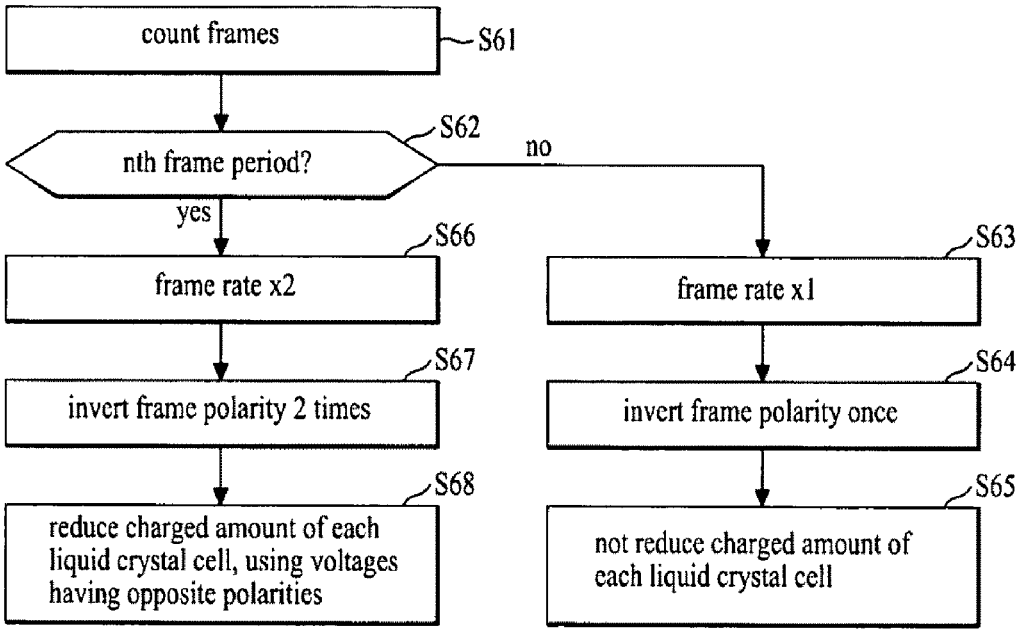
FIG. 6 is a flow chart illustrating a method for the LCD device according to an embodiment of the present invention.

FIG. 5 is a view illustrating the polarities of voltages respectively charged in the same crystal cell in a plurality of frame periods in a liquid crystal display (LCD) device according to an exemplary embodiment of the present invention. FIG. 6 is a flow chart illustrating a method for driving the LCD device in accordance with a first embodiment of the present invention.

Referring to FIGS. 5 and 6, in accordance with the LCD device driving method according to an illustrated embodiment of the present invention, a timing signal, which is input, together with digital video data, is counted, for counting of a frame period (S61).

In accordance with the LCD device driving method according to the illustrated embodiment of the present invention, a frame polarity inversion is executed at intervals of one frame period, to invert the polarity of a data voltage charged in liquid crystal cells Clc at intervals of one frame period. In accordance with the LCD device driving method, however, the frame rate in each Nth frame period is increased by 2-fold such that the LCD device is driven at a double speed, and the polarity of the data voltage supplied to the liquid crystal cells Clc is inverted twice during the Nth frame period.

"N" is integer that may be a multiple of 8 or more. From the results of DC image sticking experiments conducted for both interlace data and scroll data while varying the value of "N", it has been observed that no DC image sticking occurs for both the interlaced data and the scrolled data when "N" is a multiple of 8 or more.

The "frame polarity" means the polarity of a data voltage supplied to a specific liquid crystal cell in one frame period. The polarity of the data voltage is determined by a polarity control signal POL to control a data driving circuit.

The "frame rate" may also be referred to as a "frame frequency". The driving speed of the LCD device is determined by the frame rate. Accordingly, when the frame rate is increased by 2-fold, the frequencies of the timing control signals to control the operation timing of the data driving circuit and the operation timing of a gate driving circuit are increased by 2-fold. As a result, the driving speeds of the data driving circuit and gate driving circuit are increased by 2-fold during the 2-fold increase in frame rate.

In frame periods other than the Nth frame period, for example, during N−1 frame periods preceding the Nth frame period, the frame rate is maintained at a normal frame rate, namely, a rate "Frame Rate x1" (S62 and S63). In addition, during the N−1 frame periods preceding the Nth frame period, the polarity of the data voltage is inverted at intervals of one frame period (S64). Accordingly, in the N−1 frame periods preceding Nth frame period, there is no reduction in the charged amount of each liquid crystal cell in the condition where the data voltage charged in the liquid crystal cell has a constant gray scale (S65).

In the Nth frame period, the frame rate is increased to a rate "Frame Rate x2" (S62 and S66). Accordingly, the LCD device is driven at a double speed in the Nth frame period. In accordance with this double-speed driving, the Nth frame period is time-divided into two subframe periods.

In the Nth frame period, the polarity of the frame time-divided into two subframes (the "2× frame") is inverted 2 times (S67). That is, in the Nth frame period, the polarity of the data voltage is inverted from the polarity of the just-previous frame during a first subframe, for example, the positive polarity, to the negative polarity, and then again inverted to the positive polarity during the second subframe. Similarly, when the polarity of the data voltage in the just-previous frame is a negative polarity, the polarity of the data voltage is inverted to the positive polarity during a first subframe, and then again inverted to the negative polarity during the second subframe. Accordingly, in the Nth frame periods, each liquid crystal cell is charged with a data voltage having a polarity opposite to the frame polarity in the frame period just preceding the Nth frame period, and is subsequently charged with a data voltage having a polarity identical to the frame polarity in the frame period just preceding the Nth frame period. As a result, the charged amount of each liquid crystal cell in the Nth frame period is decreased due to the charge of the data voltages having opposite polarities.

In accordance with an LCD device driving method according to another embodiment of the present invention, the frame rate may be increased by an integer-fold of 2 or more in the Nth frame period, and with the frame polarity during the Nth frame period being inverted by a predetermined number of times corresponding to an integer of 2 or more in each Nth frame period.

Figure 8:
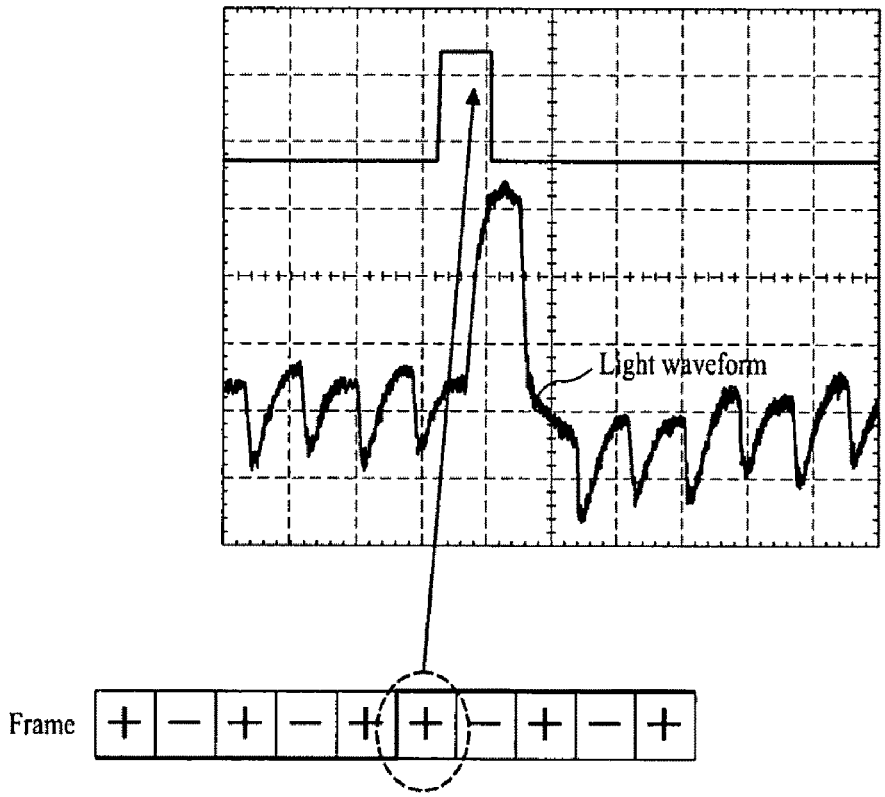
FIG. 8 is a light waveform diagram illustrating the experimental results showing an increase in light amount in an Nth frame period when no voltage having an opposite polarity is charged in the Nth frame period.
Figure 9:
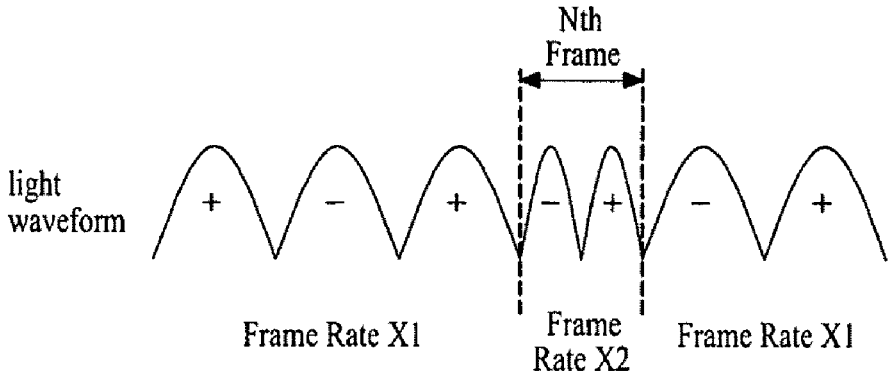
FIG. 9 is a light waveform diagram depicting effects of reducing flicker in an Nth frame period in accordance with a reduction in the charged amount of each liquid crystal cell achieved using a data voltage having an opposite polarity in the Nth frame period.
Figure 10:
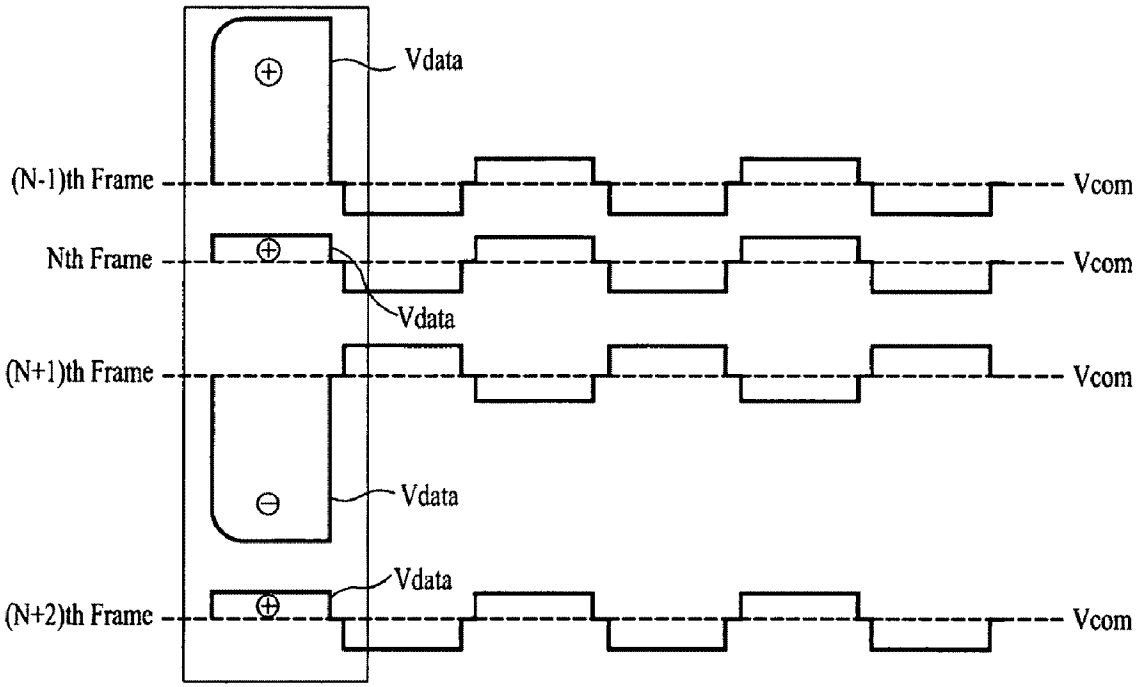
FIG. 10 is a view for explaining the principle of preventing DC image sticking and flicker from occurring in association with interlace data in the LCD device driving method according to the embodiment of the present invention.

FIGS. 8 to 10 are views for explaining the effect of preventing or reducing DC image sticking and flicker from occurring when scrolled data is supplied to the LCD device, in accordance with embodiments of the present invention.

In accordance with the present invention, for scrolled data to move a symbol or character at a rate of 8 pixels per frame, the polarity of the data voltage to be supplied to each liquid crystal cell is controlled, using a polarity control signal, such that it is inverted at intervals of one frame period, while being maintained to be constant between the seventh frame period and the eighth frame period. As a result, the polarity of the data voltage charged in the liquid crystal cell in (8's multiple) th frame periods and frame periods respectively preceding the (8's multiple)th frame periods, namely, shaded frame periods in FIG. 7, is varied in the order of "+(−)+"→"−(+)−"→"+(−)+"→"−(+)−". Here, "( )" means a voltage, which is generated just before a data voltage having a normal polarity, while having a polarity opposite to the normal polarity of the data voltage, in accordance with a 2-fold-accelerated driving operation in the Nth frame period. Thus, in accordance with the present invention, for scroll data to move a symbol or character at a certain rate, the polarity of the voltage, which is charged in each liquid crystal cell Clc, is periodically inverted, thereby preventing DC image sticking occurring due to an accumulation of voltages having the same polarity.

If the opposite-polarity voltage "( )" is not supplied in each of the Nth frame period, a data voltage, which has the same polarity as that of the frame period just preceding the Nth frame period, is repeatedly charged in the liquid crystal cell. In this case, although the occurrence of DC image sticking is prevented, the charged amount of the liquid crystal cell in the Nth frame period increases over a desired level, so that the amount of light increases, as shown in the light waveform of FIG. 8, which is an output waveform of a photodiode arranged on the LCD panel. Due to the accumulation of voltages having the same polarity, as described above, an abnormal increase in brightness occurs at intervals of N−1 frame periods. That is, a flicker phenomenon may occur. To address this problem, in accordance with the present invention, in the Nth frame period, the opposite-polarity data voltage "( )" is charged in the liquid crystal cell, and then the data voltage, which has a normal polarity, is charged in the liquid crystal cell, to reduce the charged amount of the liquid crystal cell in the Nth frame period, and thus to prevent flicker.

When the LCD device is driven at a 2-fold-accelerated speed, namely, a rate "Frame Rate x2", in the Nth frame period in such a manner that the liquid crystal cell is charged with a data voltage having an opposite polarity in a preceding one of subframe periods in the Nth frame period, and is then charged with a data voltage having a normal polarity in a following one of the subframe periods, the light amount of the liquid crystal cell is substantially equal to the light amount in the frame periods other than the Nth frame period. Meanwhile, the LCD device is driven at a normal frame rate, namely, a rate "Frame Rate x1" in the frame periods other than the Nth frame period.

FIG. 10 is a view for explaining effects of preventing DC image sticking and flicker from occurring when interlace data is supplied to the LCD device, in accordance with the above-described embodiments of the present invention.

Referring to FIG. 10, when interlace data is supplied to the liquid crystal cell Clc, high data voltages are supplied to the liquid crystal cell Clc only in the (N−1)th frame period and (N+1)th frame period, respectively, whereas a black voltage or a mean voltage, which is lower than the high data voltages, is supplied to the liquid crystal cell Clc in the Nth frame period and (N+2)th frame period. As a result, the positive data voltage supplied in the (N−1)th frame period and the negative data voltage supplied in the (N+1)th frame period are neutralized, so that there is no polarity-biased voltage accumulated in the liquid crystal cell Clc. Accordingly, no DC image sticking or flicker occurs in the LCD device when interlace data is supplied, in accordance with the embodiment of the present invention.

Figure 11:
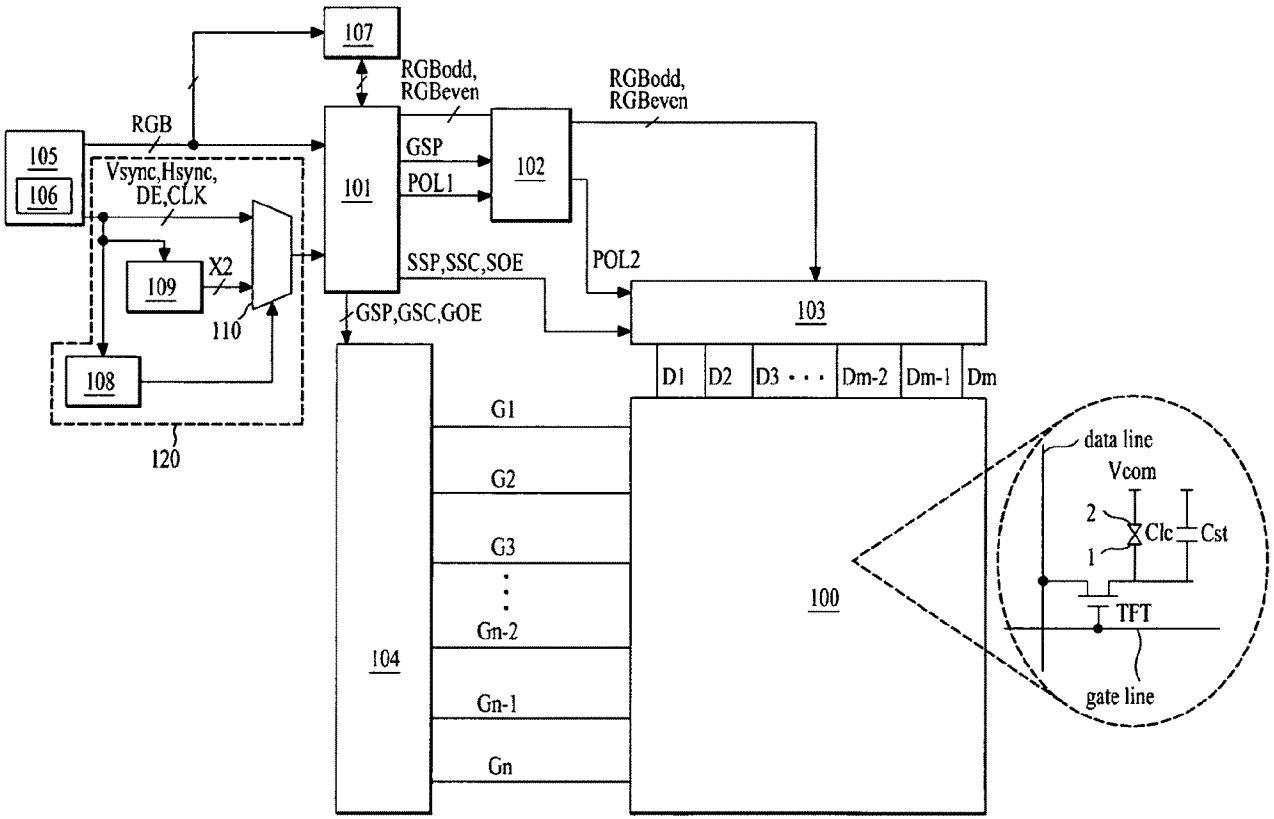
FIG. 11 is a block diagram illustrating an LCD device according to a first embodiment of the present invention.

FIG. 11 is an LCD device according to a first embodiment of the present invention.

Referring to FIG. 11, the LCD device according to the first embodiment of the present invention includes an LCD panel 100, a frame rate adjusting circuit 120, a frame memory 107, a timing controller 101, a logic circuit 102, a data driving circuit 103, and a gate driving circuit 104.

The LCD panel 100 includes two glass substrates, between which liquid crystal molecules are sealed. The LCD panel 100 also includes m×n liquid crystal cells Clc arranged in a matrix structure defined by m data lines D1 to Dm crossing n gate lines G1 to Gn.

Formed on a lower one of the glass substrates of the LCD panel 100 are the data lines D1 to Dm, the gate lines G1 to Gn, thin film transistors (TFTs), pixel electrodes 1 of respective liquid crystal cells Clc coupled to the TFTs, and storage capacitors Cst. A black matrix, color filters, and common electrodes 2 are formed on the upper glass substrate. In a vertical electric field driving system such as a twisted nematic (TN) mode or a vertical alignment (VA) mode, the common electrodes 2 are formed on the upper glass substrate, as described above. On the other hand, in a horizontal electric field driving system such as an in-plane switching (IPS) mode or a fringe field switching (FFS) mode, the common electrodes 2 are formed on the lower glass substrate together with the pixel electrodes 1. Polarizing plates having optical axes orthogonal to each other are attached to the upper and lower glass substrates, respectively. An alignment film is formed at an interface between each polarizing plate and the liquid crystals to set a pre-tilt angle of the liquid crystals.

The frame rate adjusting circuit 120 controls the frame rate such that the frame rate is increased to a 2-fold-accelerated rate in the Nth frame period, while being maintained at a 1-fold rate in frame periods other than the Nth frame period. For the purpose of performing this function, the frame rate adjusting circuit 120 includes a frame determining circuit 108, a timing signal multiplying circuit 109, and a multiplexer 110.

The frame determining circuit 108 receives reference timing signals such as reference vertical/horizontal synchronizing signals Vsync and Hsync, a reference data enable signal DE, and a reference clock signal CLK, and counts the vertical synchronizing signal to determine the number of frames. Based on the determined number of frames, the frame determining circuit 108 generates select signals indicating respective frame periods.

The timing signal multiplying circuit 109 receives the reference timing signals Vsync, Hsync, DE, and CLK, and doubles the frequencies of the received timing signals Vsync, Hsync, DE, and CLK. For driving the LCD device at a rate accelerated by an integer-fold of 2 or more, the timing signal multiplying circuit 109 multiplies the frequency of each timing signal by a multiple of "i" (where "i" is an integer of 2 or more).

The multiplexer 110 receives the multiplied timing signals X2 from the timing signal multiplying circuit 109, together with the reference timing signals Vsync, Hsync, DE, and CLK, and selectively supplies the multiplied timing signals X2 or the reference timing signals Vsync, Hsync, DE, and CLK to the timing controller 101, in response to a select signal from the frame determining circuit 108. More particularly, in the Nth frame period, the multiplexer 110 supplies the multiplied timing signals X2 to the timing controller 101 in response to the select signal from the frame determining circuit 108. On the other hand, in frame periods other than the Nth frame period, the multiplexer 110 supplies the reference timing signals Vsync, Hsync, DE, and CLK to the timing controller 101 in response to the select signal from the frame determining circuit 108.

The timing controller 101 receives the reference timing signals Vsync, Hsync, DE, and CLK or the multiplied timing signals X2, and generates timing control signals to control the operation timings of the data driving circuit 103, gate driving circuit 104, and logic circuit 102, based on the received timing signals. The frequency of each timing control signal is varied in accordance with the frequencies of the timing signals received by the timing controller 101. The timing control signals include gate timing control signals such as a gate start pulse GSP, a gate shift clock signal GSC, and a gate output enable signal GOE. The timing control signals also include data timing control signals such as a source start pulse SSP, a source sampling clock SSC, a source output enable signal SOE, and a first polarity control signal POL1. The gate start pulse GSP is a timing control signal indicating a first scan pulse to be supplied to a start horizontal line, from which a scanning operation starts in one vertical period for displaying one frame, namely, a first gate line. The gate shift clock signal GSC is a timing control signal, which is input to shift registers included in the gate driving circuit 104, to sequentially shift the gate start pulse GSP. The source start pulse SSP indicates a start pixel on one horizontal line to display data. The source sampling clock SSC enables a data latch operation of the data driving circuit 103 based on a rising or falling edge. The source output enable signal SOE enables an output from the data driving circuit 103. The first polarity control signal POL1 indicates the polarity of a data voltage to be supplied to the liquid crystal cells Clc of the LCD panel 100. The first polarity control signal POL1 has the form of a 1-dot inversion polarity control signal to invert a logic value at intervals of one horizontal period or a 2-dot inversion polarity control signal to invert a logic valve at intervals of two horizontal periods. The timing controller 101 generates the timing control signals for the driving circuits on the basis of a frame frequency of 120 Hz or 60 Hz, to control the operation timings of the first logic circuit 102, data driving circuit 103, and gate driving circuit 104 at a frequency determined on the basis of the frame frequency of 120 Hz or 60 Hz. The frame frequency is a frequency corresponding to the vertical synchronizing signal Vsync. This frame frequency indicates the number of frames per second. For example, at a frame frequency of 120 Hz, 120 frames per second are displayed on the LCD panel 100. At a frame frequency of 60 Hz, 60 frames per second are displayed on the LCD panel 100. When the LCD device is driven at the frame frequency of 120 Hz, the viewer can see no or little flicker, as compared to the driving at the frame frequency of 60 Hz. To this end, it is desirable to generate control signals on the basis of the frame frequency of 120 Hz, in order to enhance the effect of preventing flicker.

When the frame frequency is 60 Hz, the timing controller 101 generates gate timing control signals and data timing control signals at a frequency of 120 Hz in the Nth frame period, in response to the multiplied timing signals X2. In addition, when the frame frequency is 60 Hz, the timing controller 101 generates gate timing control signals and data timing control signals at a frequency of 60 Hz in frame periods other than the Nth frame period, in response to the reference timing signals Vsync, Hsync, DE, and CLK.

On the other hand, when the frame frequency is 120 Hz, the timing controller 101 generates gate timing control signals and data timing control signals at a frequency of 240 Hz in the Nth frame period, in response to the multiplied timing signals X2. In addition, when the frame frequency is 120 Hz, the timing controller 101 generates gate timing control signals and data timing control signals at a frequency of 120 Hz in frame periods other than the Nth frame period, in response to the reference timing signals Vsync, Hsync, DE, and CLK.

The timing controller 101 stores digital video data RGB of an Nth frame in the frame memory 107, and repeatedly supplies the stored data RGB to the data driving circuit 103 during the Nth frame period, with the number of repetitions corresponding to the frame rate multiplying factor for the Nth frame. The timing controller 101 also divides the input digital video data RGB into odd pixel data RGBodd and even pixel data RGBeven, thereby reducing the transfer frequency for the data to be supplied to the logic circuit 102 to ½.

Figure 14:
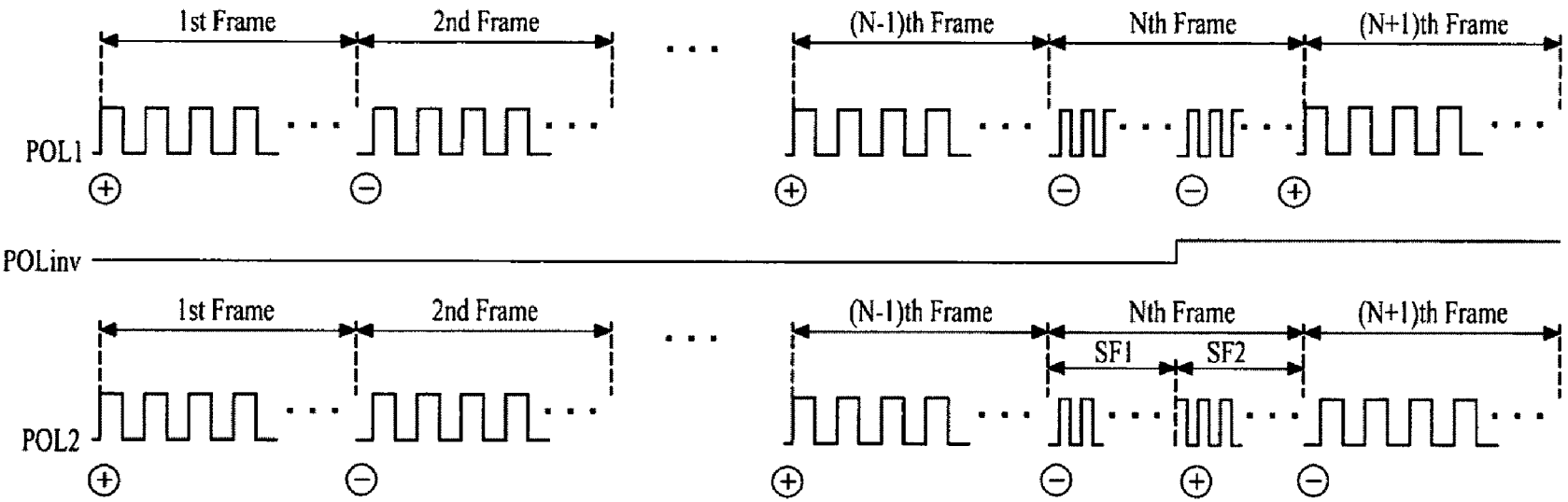
FIG. 14 is a waveform diagram depicting first and second polarity control (POL) signals and a POL inverting signal shown in FIG. 12.

The logic circuit 102 receives the gate start pulse GSP and the first polarity control signal POL1, and generates a second polarity control signal POL2 as shown in FIG. 14, in response to the received signal, in order to prevent the occurrence of DC image sticking and flicker. As shown in FIG. 14, the first polarity control signal POL1 is inverted in logic value at intervals of one horizontal period or two horizontal periods. The first polarity control signal POL1 is also inverted in phase at intervals of one frame period, in order to invert the polarity of the data voltage at intervals of one frame period. In the Nth frame period, the first polarity control signal POL1 has a frequency increased by 2-fold, and a period reduced to ½, in accordance with the 2-fold-accelerated frame rate. The second polarity control signal POL2 has the same frequency as the first polarity control signal POL1, as shown in FIG. 14. However, the phase of the second polarity control signal POL2 is varied to be opposite to the phase of the first polarity control signal POL1, at the start point of the second subframe period SF2 in the Nth frame period.

The data driving circuit 103 latches the digital video data RGBodd and RGBeven input from the logic circuit 102 under the control of the timing controller 101. The data driving circuit 103 also converts the latched digital video data RGBodd and RGBeven into positive/negative analog gamma compensating voltages in accordance with the second polarity control signal POL2, and thus generates positive/negative analog data voltages. The data voltages from the data driving circuit 103 are supplied to the data lines D1 to Dm.

The gate driving circuit 104 includes a plurality of gate drive integrated circuits each including a shift register, a level shifter for converting an output signal of the shift register into a signal having a swing width suitable for the driving of the TFTs of the associated liquid crystal cells, and an output buffer coupled between the level shifter and an associated one of the gate lines G1 to Gn. The gate driving circuit 104 sequentially supplies a scan pulse to the gate lines G1 to Gn, in response to the gate timing control signals.

The LCD device according to the illustrated embodiment of the present invention further includes a system 105 for supplying the digital video data RGB and timing signals Vsync, Hsync, DE, and CLK to the timing controller 101.

The system 105 includes a broadcast signal receiver, an external appliance interface circuit, a graphic processing circuit, a line memory 106, etc. The system 105 extracts video data from a broadcast signal received by the broadcast signal receiver or an image source input from an external appliance through the external appliance interface circuit, converts the extracted video data into digital video data, and supplies the digital video data to the timing controller 101. An interlaced broadcast signal, which is received by the system 105, is stored in the line memory 106. The video data of the interlaced broadcast signal exists only on odd lines in odd frame periods, and exists only on even lines in even frame periods. Accordingly, when the system 105 receives an interlaced broadcast signal, it generates even line data for odd frame periods and odd line data for even frame periods, using a mean value of effective data stored in the line memory 106 or a black data value. The system 105 supplies the timing signals Vsync, Hsync, DE, and CLK to the timing controller 101, together with the digital video data. The system 105 also supplies electric power to a DC-DC converter functioning to generate drive voltages for the timing controller 101, first and second logic circuits 102 and 107, data driving circuit 103, gate driving circuit 104, and LCD display panel 100. The system 105 also supplies electric power to an inverter for turning on a light source included in a backlight unit.

The frame rate adjusting circuit 120, frame memory 107, timing controller 101, and logic circuit 102 can be integrated in the form of one chip.

Figure 12:
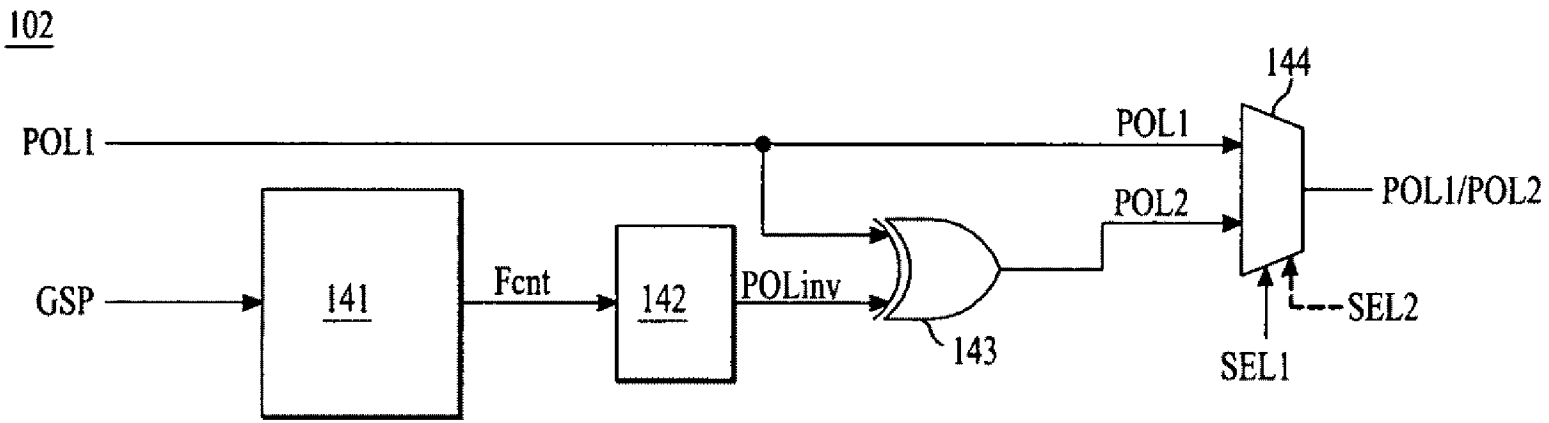
FIG. 12 is a block diagram illustrating a detailed configuration of a logic circuit according to the first embodiment of the present invention.

FIG. 12 is a circuit diagram illustrating a detailed configuration of the logic circuit 102 according to an exemplary embodiment of the present invention.

Referring to FIG. 12, the logic circuit 102 includes a frame counter 141, a POL inverter 142, an exclusive OR gate (hereinafter, referred to as an "XOR gate") 143, and a multiplexer 144.

Figure 13:
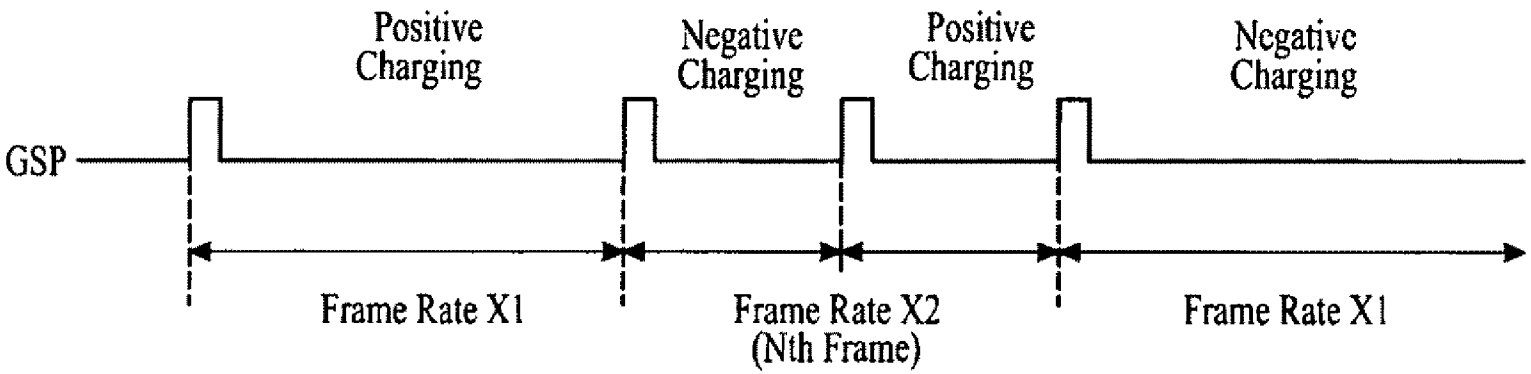
FIG. 13 is a waveform diagram depicting a gate start pulse generated when the frame rate is increased to a 2-fold-accelerated rate in an Nth frame period.

The frame counter 141 counts the gate start pulse GSP, and thus generates frame count information Fcnt indicating the number of frames. The gate start pulse GSP is generated once in each of the frame periods other than the Nth frame period, in synchronism with the start of one frame period. On the other hand, in the Nth frame period, the gate start pulse-GSP is generated two times in accordance with the 2-fold-accelerated frame rate at the start points of the first and second subframe periods of the Nth frame period, respectively, as shown in FIG. 13. That is, the gate start pulse GSP is generated two times during the Nth frame period. The gate driving circuit 104 sequentially supplies a scan pulse to the gate lines G1 to Gn, in response to the gate start pulse GSP. Thus, the gate driving circuit 104 supplies a scan pulse to the gate lines G1 to Gn in the first subframe period SF1 of the Nth frame period, and then supplies a scan pulse to the gate lines G1 to Gn in the second subframe period SF2 of the Nth frame period.

The POL inverter 142 receives the frame count information Fcnt from the frame counter 141, and performs a modulo operation on the received frame count information Fcnt by using "x" as the modulus (where "x" is an integer of 8 or more), and detects the point of time when a result of "0" is obtained from the modulo operation. The POL inverter 142 executes a logic inversion at the point of time delayed from the detected time point by a ½ frame period, and thus generates a POL inverting signal POLinv. Thus, the point of time when the logic value of the POL inverting signal POLinv is inverted corresponds to the start point of the second subframe SF2 of the Nth frame period, as shown in FIG. 14.

The XOR gate 143 XORs (exclusive ors) on the first polarity control signal POL1 and POL inverting signal POLinv to generate the second polarity control signal POL2 as shown in FIG. 14.

The multiplexer 144 selects one of the first and second polarity control signals POL1 and POL2 under the control of a first select signal SEL1. The first select signal SEL1 may be determined by an option pin coupled to a control terminal of the multiplexer 144. The option pin may be selectively coupled to a ground voltage GND or a supply voltage Vcc by a manufacturer. For example, when the option pin is coupled to the ground voltage GND, a value of "0" is supplied to the control terminal of the multiplexer 144, as the first select signal SEL1. In this case, the multiplexer 144 outputs the second polarity control signal POL2. On the other hand, when the option pin is coupled to the ground voltage GND, a value of "1" is supplied to the control terminal of the multiplexer 144, as the first select signal SEL1. In this case, the multiplexer 144 outputs the second polarity control signal POL1. The multiplexer 144 may automatically select one of the first and second polarity control signals POL1 and POL2 in accordance with a second select signal SEL2, which is generated in accordance with the results of a determination made for an input image in a second embodiment of the present invention. Details of the second embodiment will be described herein with reference to FIG. 17.

Figure 15:
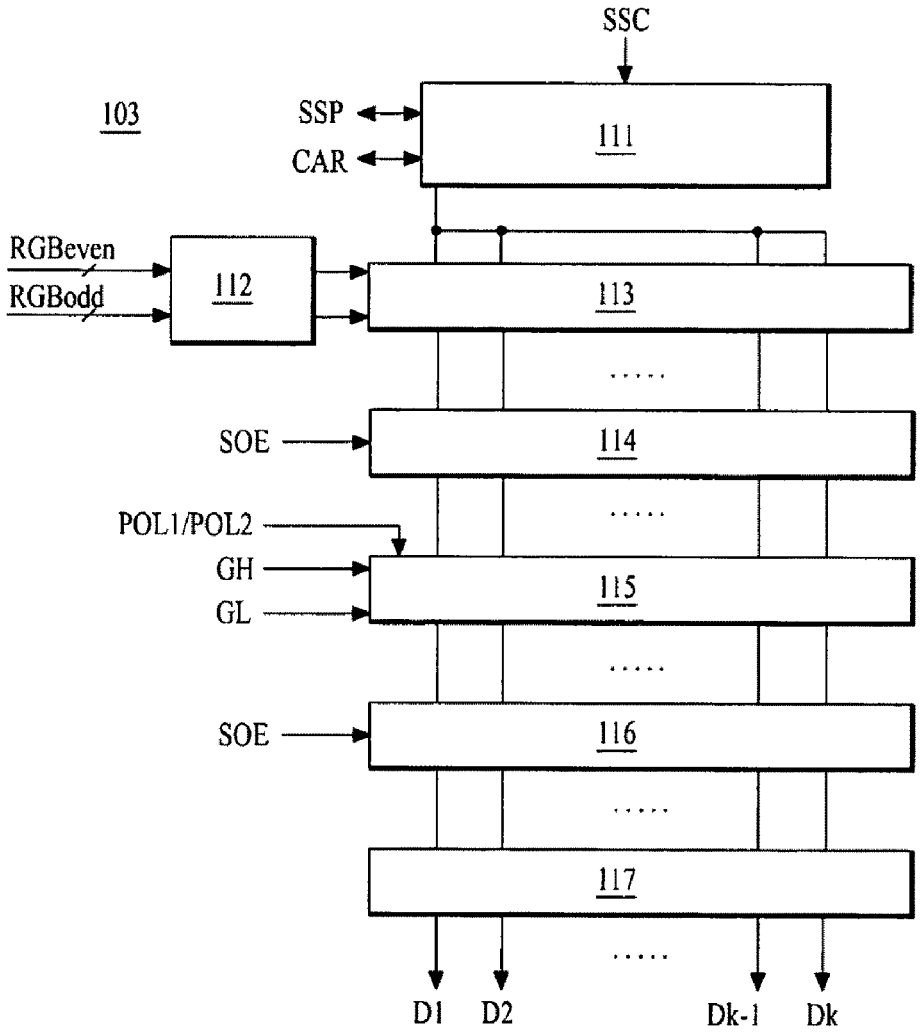
FIG. 15 is a block diagram illustrating a detailed configuration of a data driving circuit shown in FIG. 11.
Figure 16:
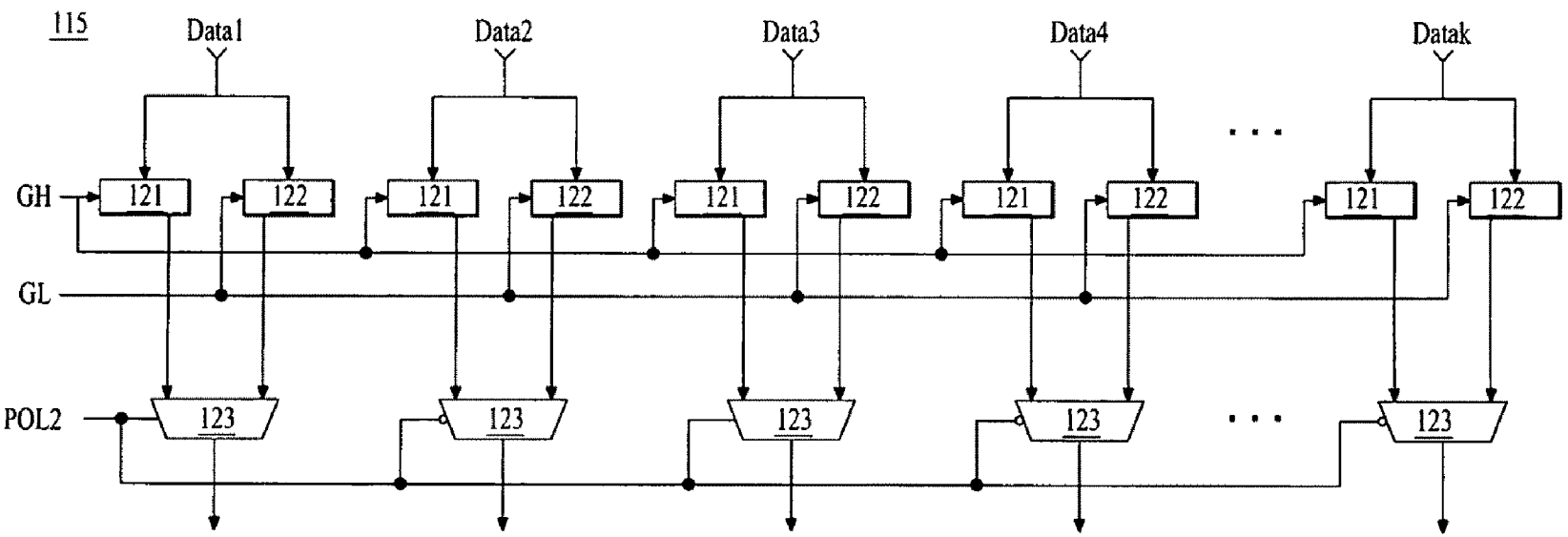
FIG. 16 is a circuit diagram illustrating a detailed configuration of a digital/analog converter shown in FIG. 15.

FIGS. 15 and 16 are circuit diagrams illustrating a detailed configuration of the data driving circuit 103.

Referring to FIGS. 15 and 16, the data driving circuit 103 includes a plurality of source integrated circuits (ICs). Each source IC drives k data lines ("k" is an integer less than "m"), for example, data lines D1 to Dk.

Each source IC includes a shift register 111, a data register 112, a first latch 113, a second latch 114, a digital/analog converter (hereinafter, referred to as a "DAC") 115, a charge share circuit 116, and an output circuit 117.

The shift register 111 shifts the source start pulse SSP output from the timing controller 101, in accordance with the source sampling clock SSC, and thus generates a sampling signal. The shift register 111 also transfers the shifted source start pulse SSP to the shift register 111 included in the next-stage source IC, as a carry signal CAR.

The data register 112 temporarily stores the odd digital video data RGBodd and even digital video data RGBeven divided by the timing controller 101, and supplies the stored data RGBodd and RGBeven to the first latch 113.

The first latch 113 samples the digital video data RGBeven and RGBodd, in response to sampling signals sequentially input from the shift register 111, and latches the sampled digital video data RGBeven and RGBodd, and simultaneously outputs the latched data.

The second latch 114 latches data of one horizontal line input from the first latch 113, and outputs the latched digital video data in a low logic period of the source output enable signal SOE, simultaneously with the second latches 114 of the remaining source ICs.

As shown in FIG. 16, the DAC 115 includes P-decoders (PDECs) 121, to which a positive gamma compensating voltage GH is supplied, N-decoders (NDECs) 122, to which a negative gamma compensating voltage GL is supplied, and multiplexers 123 each coupled to an associated one of the PDECs 121 and an associated one of the NDECs 122, to select an output from the associated PDEC 121 or an output from the associated NDEC 122 in response to the polarity control signal POL1 or POL2. Each PDEC 121 decodes digital video data input from the associated second latch 114, and outputs a positive gamma compensating voltage GH corresponding to the gray scale value of the decoded digital video data. Each NDEC 122 decodes digital video data input from the associated second latch 114, and outputs a negative gamma compensating voltage GL corresponding to the gray scale value of the decoded digital video data. Each multiplexer 123 selects the positive gamma compensating voltage GH or negative gamma compensating voltage GL in response to the polarity control signal POL1 or POL2, and outputs the selected positive or negative gamma compensating voltage GH or GL, as an analog data voltage. In response to the second polarity control signal POL2 as shown in FIG. 14, the DAC 115 outputs data voltages inverted in polarity at intervals of one horizontal period (or two horizontal period) and at intervals of one frame period, in frame periods other than the Nth frame period. In response to the second polarity control signal POL2, the DAC 115 also outputs data voltages inverted in polarity at intervals of one horizontal period (or two horizontal period) while having a polarity opposite to that of the just-previous frame, in the first subframe period SF1 of the Nth frame period, and then outputs data voltages having polarities inverted at intervals of one horizontal period (or two horizontal periods) and at intervals of one frame period while being opposite to that of the first subframe SF1, in the second subframe period SF2 of the Nth frame period.

The charge share circuit 116 short-circuits neighboring data output channels in a high-logic period of the source output enable signal SOE, and thus outputs a mean voltage of neighboring data voltages, as a charge share voltage. The charge share circuit 116 also supplies a common voltage Vcom to the data output channels in the high-logic period of the source output enable signal SOE, to reduce the data voltage swing width between the positive and negative data voltages.

The output circuit 117 includes a buffer to minimize a signal attenuation of the analog data voltages supplied to the data lines D1 to Dk.

Figure 17:
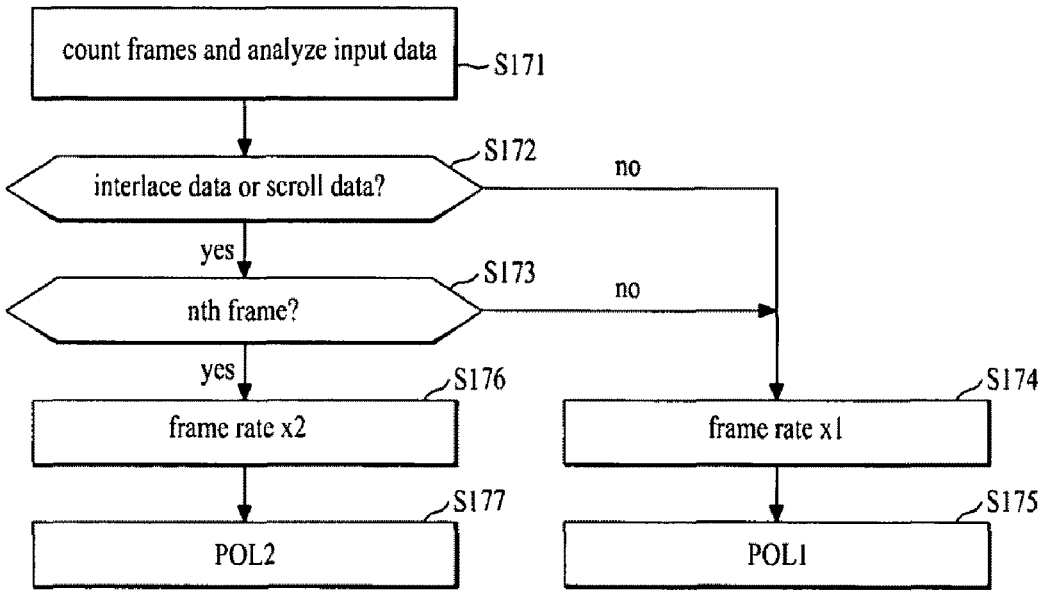
FIG. 17 is a flow chart for explaining a method for driving an LCD device in accordance with a second embodiment of the present invention.

FIG. 17 is a flow chart for explaining a method for driving the LCD device in accordance with the second embodiment of the present invention.

In the LCD device driving method according to the second embodiment of the present invention, as shown in FIG. 17, input data is first analyzed, to determine whether or not the input data corresponds to data having a possibility of DC image sticking, such as interlaced data or scrolled data, and the counting of a frame period is counted (S171 and S172).

In accordance with the second embodiment of the present invention, data of two neighboring lines is repeatedly compared, using a line memory and a comparator, to determine whether or not the difference in data between the two neighboring lines is equal to or higher than a predetermined critical value. When the data difference between the two neighboring lines is equal to or higher than the predetermined critical value, the input data may be determined to be interlaced data. In accordance with the second embodiment of the present invention, the current frame image may be compared with the previous frame images, using the frame memory and comparator, to detect a portion of the current frame moving at a predetermined speed. When such a frame portion is detected, the input data may be determined to be scrolled data.

When the currently-input data is not determined to be data having a possibility of DC image sticking, and the current frame period is not the Nth frame period, the polarity of the data voltage supplied to each liquid crystal cell is controlled in accordance with the first polarity control signal POL1, without a frame rate adjustment (S173 to S175). Since the first polarity control circuit POL1 is not varied in frequency and cycle at a frame rate "Frame Rate x1", it is generated at the same frequency and cycle as those of frame periods other than the Nth frame period, without being increased in frequency in the Nth frame period, as shown in FIG. 14. Accordingly, when the currently-input data is not data having a possibility of DC image sticking, and the current frame period is not the Nth frame period, the charged amount of each liquid crystal cell in the Nth frame period is not reduced.

On the other hand, when the currently-input data is data having a possibility of DC image sticking, and the current frame period is the Nth frame period, the frame rate is adjusted to a 2-fold-accelerated rate, and the polarity of the data voltage supplied to each liquid crystal cell is controlled in accordance with the second polarity control signal POL2. Accordingly, when the currently-input data is data having a possibility of DC image sticking, or the current frame period is the Nth frame period, each liquid crystal cell is charged with an opposite-polarity data voltage, and is then charged with a normal-polarity data voltage in the Nth frame period (S173, S176, and S177). In this case, accordingly, the charged amount of each liquid crystal cell in the Nth frame period is reduced.

Figure 18:
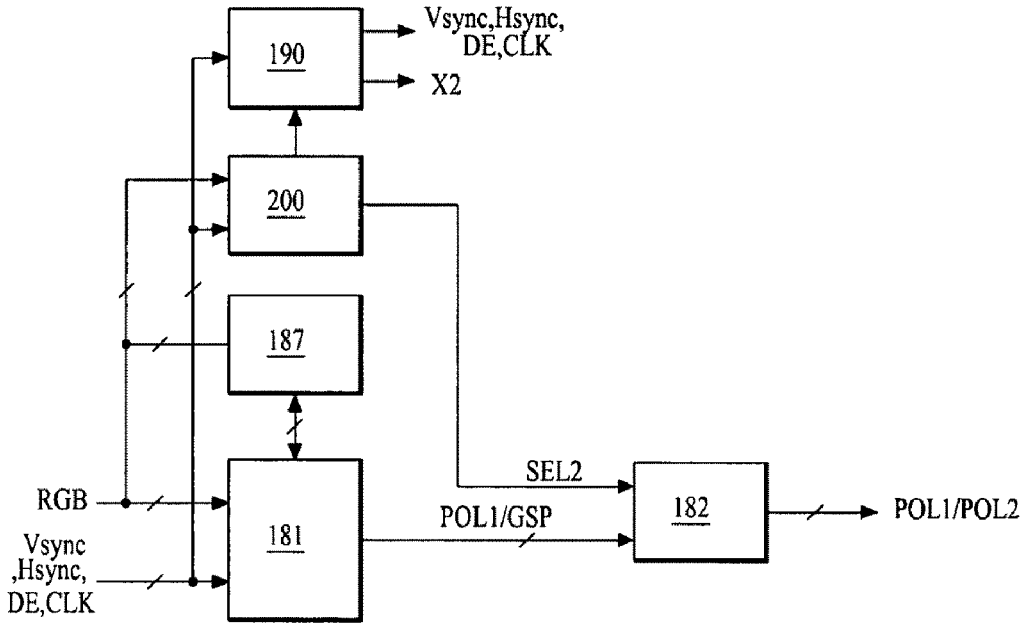
FIG. 18 is a block diagram illustrating an LCD device according to a second embodiment of the present invention.

FIG. 18 illustrates an LCD device according to a second embodiment of the present invention. Since the system, LCD panel, data driving circuit, and gate driving circuit in this embodiment are substantially identical to those of the previous embodiment, no illustration thereof is given in FIG. 18.

Referring to FIG. 18, the LCD device according to the second embodiment of the present invention includes an image analyzer 200, a frame memory 187, a frame rate adjusting circuit 190, a timing controller 181, and a logic circuit 182.

The image analyzer 200 determines whether or not the digital video data RGB of the currently-input image is data having a possibility of DC image sticking. The image analyzer 200 compares data of neighboring lines in one frame of the input image. When the data difference between the neighboring lines is higher than a predetermined critical value, the image analyzer 200 determines the currently-input data as interlaced data. The image analyzer 200 also compares data of pixels for every frame, to detect a moving portion of the displayed image and the moving speed of the moving image. When the moving image moves at a predetermined speed, the image analyzer 200 determines the frame data including the moving image, as scrolled data.

When it is determined, from the results of the above-described image analysis, that data having a possibility of DC image sticking, such as interlaced data or scrolled data is input, the image analyzer 200 enables the frame rate adjusting circuit 120, and controls the logic circuit 182, using the select signal SEL2, to generate the second polarity control signal POL2. Further, when the currently-input data is not data having a possibility of DC image sticking such as interlaced data or scrolled data, and the current frame period is not the Nth frame period, the image analyzer 200 disables the frame rate adjusting circuit 120, and controls the logic circuit 182, using the select signal SEL2, to generate the first polarity control signal POL1, which has a constant frequency and a constant cycle in all frame periods.

Using the circuit configuration as shown in FIG. 11, the frame rate adjusting circuit 190 controls the frame rate under the control of the image analyzer 200 such that the frame rate is increased to a 2-fold-accelerated rate in the Nth frame period, and is maintained at a 1-fold rate in frame periods other than the Nth frame period. For this function, the frame rate adjusting circuit 190 includes the frame determining circuit 108, timing signal multiplying circuit 109, and multiplexer 110.

The timing controller 181 receives the reference timing signals Vsync, Hsync, DE, and CLK or the multiplied timing signals X2, and thus generates timing control signals to control the operation timings of the data driving circuit, gate driving circuit, and logic circuit 192.

The logic circuit 102 has a circuit configuration as shown in FIG. 12. The logic circuit 102 selectively generates the first polarity control signal POL1 or the second polarity control signal POL2 under the control of the image analyzer 200.

Figure 19:
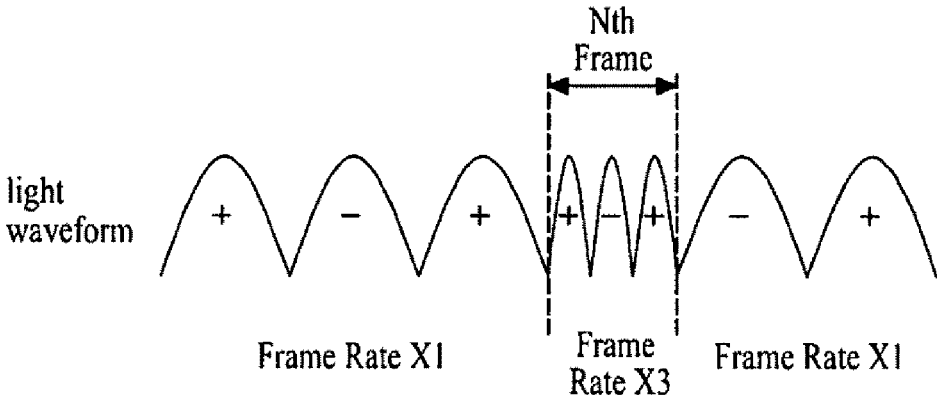
FIG. 19 is waveform diagram illustrating a three-fold accelerated frame rate in an Nth frame period according to an embodiment of the current invention.

In accordance with this embodiment of the present invention, the frame rate may be increased to a rate "Frame Rate×i" ("i" is a positive integer of 2 or more) in the Nth frame period, and the polarity of the data voltage may be inverted by "i" inversion times in the Nth frame period in accordance with the increased frame rate, as described above. For example, in accordance with an embodiment of the present invention, as shown in FIG. 19, the frame rate may be increased to a rate "Frame Rate x3" in the Nth frame period, and the polarity of the data voltage may be repeatedly inverted in the order of positive, negative, and positive in the Nth frame period in accordance with the increased frame rate.

As apparent from the above description, in accordance with the LCD device and driving method thereof according to any one of the above-described embodiments of the present invention, the frame rate in an Nth frame period may be increased such that the frame period is divided into a plurality of subframe periods. A data voltage having a polarity opposite to a normal polarity identical to the polarity of the frame period just previous to the Nth frame period is supplied to each liquid crystal cell in at least one of the subframe periods, to reduce the charged amount of the liquid crystal cell in the Nth frame period, whereas a data voltage, which has the normal polarity, is supplied to each liquid crystal cell in the remaining subframe periods. As a result, it is possible to prevent the occurrence of DC image sticking and flicker, and thus to achieve an enhancement in display quality.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device comprising:

a liquid crystal display panel formed with a plurality of data lines and a plurality of gate lines, the liquid crystal display panel having a plurality of liquid crystal cells;

a frame rate adjusting circuit for controlling a frame rate such that the frame rate is maintained at a 1-fold rate in frame periods other than an Nth frame period, where "N" is a multiple of 8 or more, while being increased to an "i"-fold-accelerated rate, where"i" is a positive integer of 2 or more in the Nth frame period, to output reference timing signals in the frame periods other than the Nth frame period, and to output accelerated timing signals in the Nth frame period;

a timing controller for generating data timing control signals and gate timing control signals in response to at least one of each reference timing signal and each accelerated timing signal;

a logic circuit for accelerating a frequency of a polarity control signal to determine a polarity of a data voltage to be supplied to the liquid crystal cells, in the Nth frame period, the polarity control signal being included in the data timing control signals;

a data driving circuit for generating the data voltage in response to the data timing control signals including the polarity control signal; and a gate driving circuit for supplying a scan pulse to the gate lines in response to the gate timing control signals, wherein the logic circuit comprises a frame counter for counting a gate start pulse indicating a start of the scan pulse to count a number of frames, an inverter for generating an inverting signal indicating a point of time when the polarity control signal is inverted in phase in the Nth frame period, in accordance with an output from the frame counter, an exclusive OR gate for exclusively ORing a reference polarity control signal generated from the timing controller and the inverting signal, to generate the polarity control signal, and a multiplexer for outputing a selected one of the reference polarity control signal and the polarity control signal.

2. The liquid crystal display device according to claim 1, wherein the Nth frame period comprises:

at least one first subframe period, in which a data voltage having a polarity opposite to the Nth frame period is supplied to the liquid crystal cells; and at least one second subframe period, in which a data voltage having the same polarity as the Nth frame period is supplied to the liquid crystal cells.

3. The liquid crystal display device according to claim 1, wherein the frame rate adjusting circuit comprises:

a frame determining circuit for determining a frame period, based on the reference timing signals;

a timing signal multiplying circuit for multiplying the reference timing signals by the "i"-fold, to generate the accelerated timing signals; and a multiplexer for outputting the accelerated timing signals in the Nth frame period, while outputting the reference timing signals in the frame periods other than the Nth frame period, under a control of the frame determining circuit.

4. A liquid crystal display device comprising:

a liquid crystal display panel formed with a plurality of data lines and a plurality of gate lines, the liquid crystal display panel having a plurality of liquid crystal cells;

an image determiner for analyzing input digital video data and determining whether one of interlaced data and scrolled data has been input based on results of the analysis;

a frame rate adjusting circuit for controlling a frame rate such that the frame rate is maintained at a 1-fold rate in frame periods other than an Nth frame period, where "N" is a multiple of 8 or more, while being increased to an "i"-fold-accelerated rate in the Nth frame period, where "i" is a positive integer of 2 or more, upon a determination that one of interlaced data and scrolled data has been input, and to output reference timing signals in the frame periods other than the Nth frame period, and to output accelerated timing signals in the Nth frame period;

a timing controller for generating data timing control signals and gate timing control signals, based on the reference timing signals upon a determination that one of interlaced data and scrolled data has been input, and for generating the data timing control signals and the gate timing control signals based on the accelerated timing signals upon a determination that data other than interlaced data and scrolled data has been input;

a logic circuit for accelerating a frequency of a polarity control signal to determine a polarity of a data voltage to be supplied to the liquid crystal cells, in the Nth frame period, when one of the interlace data and the scroll data has been input, the polarity control signal being included in the data timing control signals;

a data driving circuit for generating the data voltage in response to the data timing control signals including the polarity control signal; and a gate driving circuit for supplying a scan pulse to the gate lines in response to the gate timing control signals, wherein the logic circuit comprises a frame counter for counting a gate start pulse indicating a start of the scan pulse to count a number of frames, an inverter for generating an inverting signal indicating a point of time when the polarity control signal is inverted in phase in the Nth frame period, in accordance with an output from the frame counter, an exclusive OR gate for exclusively ORing a reference polarity control signal generated from the timing controller and the inverting signal, to generate the polarity control signal, and a multiplexer for outputing a selected one of the reference polarity control signal and the polarity control signal.

5. A method for driving a liquid crystal display device including a liquid crystal display panel formed with a plurality of data lines and a plurality of gate lines, the liquid crystal display panel having a plurality of liquid crystal cells, the method comprising:

controlling a frame rate such that the frame rate is maintained at a 1-fold rate in frame periods other than an Nth frame period, where "N" is a multiple of 8 or more, while being increased to an "i"-fold-accelerated rate, in the Nth frame period, where "i" is a positive integer of 2 or more, to output reference timing signals in the frame periods other than the Nth frame period, and to output accelerated timing signals in the Nth frame period;

generating data timing control signals and gate timing control signals, based on at least one of each reference timing signal and each accelerated timing signal;

accelerating a frequency of a polarity control signal to determine a polarity of a data voltage to be supplied to the liquid crystal cells, in the Nth frame period, the polarity control signal being included in the data timing control signals;

generating the data voltage in response to the data timing control signals including the polarity control signal; and supplying a scan pulse to the gate lines in response to the gate timing control signals, wherein the accelerating the frequency of a polarity control signal comprises counting a gate start pulse indicating a start of the scan pulse to count a number of frames, generating an inverting signal indicating a point of time when the polarity control signal is inverted in phase in the Nth frame period, in accordance with an output from the frame counter, exclusively ORing a reference polarity control signal generated from the timing controller and the inverting signal, to generate the polarity control signal; and outputing a selected one of the reference polarity control signal and the polarity control signal.

6. The method according to claim 5, wherein the Nth frame period comprises:

at least one first subframe period, in which a data voltage having a polarity opposite to the Nth frame period is supplied to the liquid crystal cells; and at least one second subframe period, in which a data voltage having the same polarity as the Nth frame period is supplied to the liquid crystal cells.

7. A method for driving a liquid crystal display device including a liquid crystal display panel formed with a plurality of data lines and a plurality of gate lines, the liquid crystal display panel having a plurality of liquid crystal cells, the method comprising:

analyzing input digital video data and determining whether one of interlaced data and scrolled data has been input based on results of the analysis;

controlling a frame rate such that the frame rate is maintained at a 1-fold rate in frame periods other than an Nth frame period, where "N" is a multiple of 8 or more, while being increased to an "i"-fold-accelerated rate in the Nth frame period, where"i" is a positive integer of 2 or more, upon a determination that one of interlaced data and scrolled data has been input, to output reference timing signals in the frame periods other than the Nth frame period, and to output accelerated timing signals in the Nth frame period;

generating data timing control signals and gate timing control signals, based on the reference timing signals upon the determination that one of interlaced data and scrolled data has been input;

generating the data timing control signals and the gate timing control signals, based on the accelerated timing signals, upon a determination that data other than one of interlaced data and scrolled data has been been input;

accelerating a frequency of a polarity control signal to determine a polarity of a data voltage to be supplied to the liquid crystal cells, in the Nth frame period upon a determination that one of interlaced data and scrolled data has been input, the polarity control signal being included in the data timing control signals;

generating the data voltage in response to the data timing control signals including the polarity control signal; and supplying a scan pulse to the gate lines in response to the gate timing control signals, wherein the accelerating the frequency of a polarity control signal comprises counting a gate start pulse indicating a start of the scan pulse to count a number of frames, generating an inverting signal indicating a point of time when the polarity control signal is inverted in phase in the Nth frame period, in accordance with an output from the frame counter, exclusively ORing a reference polarity control signal generated from the timing controller and the inverting signal, to generate the polarity control signal; and outputing a selected one of the reference polarity control signal and the polarity control signal.

* * * * *